United States Patent [19]

Anderson et al.

[11] Patent Number: 4,748,882

[45] Date of Patent: Jun. 7, 1988

[54] TRAVELING GUILLOTINE

[75] Inventors: Charles D. Anderson; William C. Chambers, both of Abilene; Guy J. Prichard, Enterprise, all of Kans.

[73] Assignee: Combustion Engineering, Inc., Windsor, Conn.

[21] Appl. No.: 23,349

[22] Filed: Mar. 9, 1987

[51] Int. Cl.[4] ..... B26D 1/60

[52] U.S. Cl. ..... 83/327; 83/110; 83/326

[58] Field of Search ..... 83/326–328, 83/487–491, 110

[56] References Cited

U.S. PATENT DOCUMENTS

| | | | |
|---|---|---|---|
| 2,288,908 | 7/1942 | Kretchman | 83/327 X |
| 3,128,660 | 4/1964 | Gaubert | 83/328 X |
| 3,782,070 | 1/1974 | Erlandson | 83/326 X |
| 3,886,830 | 6/1975 | Holthoff et al. | 83/327 X |
| 4,027,564 | 6/1977 | Yahara | 83/328 |

*Primary Examiner*—Frank T. Yost

*Attorney, Agent, or Firm*—Arthur E. Fournier, Jr.

[57] ABSTRACT

An apparatus (10) particularly suited for use for purposes of effectuating the cutting to length of continuous lengths of relatively thick, soft stock sheet material (14) such as sheets of styrofoam which have a thickness of six inches or greater. The subject apparatus (10) includes a carriage assembly (32) mounted for movement on a support base (16). The carriage assembly (32) is driven by motor means (34) operatively connected thereto. The motor means (34) is operative to cause the carriage assembly (32) to move in a triangular path while undergoing movement in two planes at a speed which varies directly with the speed at which the soft stock sheet material (14) that is to be cut to length in the subject apparatus (10) is fed therethrough. A knife means (68) is supported on the carriage assembly (32) for movement therewith such that as the carriage assembly (32) moves in a triangular path the knife means (68) likewise moves in a triangular path, i.e., down and forward. In order to effectuate the cutting therewith of the continuous length of soft stock sheet material (14) the knife means (68) at the time of cutting must be made to move at the same speed as that at which the continuous length of soft stock sheet material (14) is moving. Thus, since the knife means (68) follows a triangular path of movement, the knife means (68) must be made to move along this triangular path at a speed which is 1.414 times the speed of the soft stock sheet material (14) that is to be cut therewith.

13 Claims, 2 Drawing Sheets

TRAVELING GUILLOTINE

BACKGROUND OF THE INVENTION

This invention relates to apparatus for effectuating the cutting of material, and more specifically, to a cutting apparatus operative for accomplishing the cutting to length of continuous lengths of relatively thick, soft stock sheet material such as sheets of styrofoam having a thickness of six inches or greater.

It is well-known in the prior art that in the course of performing many industrial processes there exists a need to accomplish a cutting operation. As such, it has long been known in the prior art to provide devices that are capable of being employed for purposes of performing a cutting operation. To this end, the prior art is replete with examples of various types of devices that have been used to effectuate the cutting of material. In this regard, in many instances discernible differences exist in the manner in which the actual cutting operation is performed. The existence of such differences is, in turn, attributable for the most part to the diverse functional requirements that are associated with the specific application in which such devices are designed to be employed. For instance, in the selection of the particular type of device that is to be utilized for a specific application one of the principal factors to which consideration must be given is that of the nature of the material which is required to be cut. Another factor to which consideration must be given is that of the thickness of the material which is required to be cut. Yet another factor to which consideration must be given is whether the material that is to be cut is moving or is stationary while the cutting operation is being performed.

As regards the subject of material, reference is had here by way of exemplification and not limitation to sheet material as being representative, generally, of one type of material wherein there exists a requirement that there be performed thereon a cutting operation. Over the passage of time, the term "sheet material" has been utilized in a variety of contexts to refer to an assortment of different products. For example, it has been known, on the one hand, to utilize the term sheet material to refer to sheets of plywood of varying thicknesses, while, on the other hand, it has also been known to utilize the term sheet material to refer to sheets of single ply paper. Further, one specific type of sheet material to which reference may be had in connection with the matter of the need to effect a cutting thereof is that of stock sheet material, and in particular soft stock sheet material such as styrofoam. Styrofoam to which reference is had here as exemplifying the type of material which is designed to be cut with the apparatus that forms the subject matter of the present invention is known to have many uses. However, regardless of the manner in which it is intended to employ the styrofoam, most often there is found to exist a need to effectuate the cutting of the styrofoam into suitable lengths. This stems principally from the fact that the process utilized in the fabrication of styrofoam results in the styrofoam being formed into continuous lengths. Accordingly, following the fabrication thereof, the styrofoam commonly must thereafter be cut up into suitable lengths.

Turning next to a consideration of the matter of the thickness of the material that is to be the subject of the cutting operation, sheet material and more specifically soft stock sheet material is known to exist in various thicknesses. For instance, soft stock sheet material such as styrofoam is known to embody thicknesses of up to six inches or greater. As such, it should be readily apparent that the manner in which the cutting of a soft stock sheet material such as styrofoam having a thickness of six inches or greater is accomplished will be different from the manner in which the cutting of a soft stock sheet material such as newsprint having a thickness measured in mils is effectuated. To this end, not only will the amount of force that is required to be employed in order to cut through material which is several inches thick differ from that which is required to cut through material that is only several mils thick, but also the amount of time that is required for the cutting means, e.g., knife blade to pass through, i.e., to effectuate the cutting of the material will likewise be different for a material that is several inches thick as opposed to a material that is only several mils thick.

When consideration is being given to the manner in which the cutting operation is influenced by the nature of the thickness of the material that is to be cut there also exists a need to take into account whether the material is moving at the time the cutting operation takes place or whether the material is stationary. To this end, in order to accomplish the cutting of the material the cutting means must undergo movement in a first direction relative to the major axis of the material that is being cut, i.e., substantially perpendicular to the material's major axis. However, if the material is moving at the time the cutting operation takes place, then the motion which the cutting means is made to undergo during the cutting operation must also encompass a second component. That is, when the material is moving at the time the cutting operation takes place, the cutting means must move not only in a first direction that extends substantially perpendicular to the major axis of the material which is being cut, but also the cutting means must in addition move in a second direction that extends substantially parallel to the direction of movement of the material which is being cut, i.e., in the same direction as the direction of movement of the major axis of the material that is being cut. Continuing, as discussed herein previously the length of time that it takes to cut through the material commonly will vary as a function of the thickness of the material that is being cut. Furthermore, if the material is moving at the time the material is being cut, the length of time that the cutting means is required to be moved both in the first direction, i.e., substantially perpendicular to the major axis of the material that is being cut, and in the second direction, i.e., substantially parallel to the major axis of the material that is being cut, normally will vary not only as a function of the thickness of the material that is to be cut but also as a function of the speed at which the material is moving as the material is undergoing cutting.

It is normally to be expected that when continuous lengths of material such as in particular continuous lengths of soft stock sheet material are to be cut, economies of operation can be realized if the cutting operation that is to be performed on the material is performed while the material is moving. That is, commonly it is to be expected that it would be possible to cut more pieces of material from a continuous length of material in a given period of time if the material is moving at the time it undergoes cutting than if the material is stationary when being cut. Notwithstanding the fact though that the rate of production of pieces of cut material may be better if the material is moving when cut rather than being stationary, this improved rate of production will be of no avail if the nature of the cut that is made during movement of the material is not of the desired quality. In summary, therefore, when one considers for use a process wherein a continuous length of material is cut into shorter lengths while the material is moving, not only must one through the use of the subject process be able to realize a better rate of production of pieces of cut material but also the nature of the cut made when employing the subject process must be of the desired quality.

There are known to exist in the prior art a number of different processes which are said to be suitable for use for purposes of accomplishing the cutting of continuous lengths of sheet material while the latter material is moving, i.e., for accomplishing the cutting of continuous lengths of sheet material while the latter material, so to speak, is "on the fly". In this regard, by way of illustration, reference is had here to one such process wherein in accord with the mode of operation thereof a rotary cut-off of the material occurs in which as a result of the blades mounted on two rotating shafts coming together material that passes therebetween is cut. Another process by which the cutting of continuous lengths of sheet material is known to have been effected while the material is moving involves the use of a circular saw blade which travels diagonally across the sheet material as the latter passes by the saw blade thereby resulting in a straight cut by the saw blade of the sheet material.

With regard to the process wherein the rotary cut-off procedure is employed, it has been found that the performance which is capable of being realized through the use thereof in terms of the rate of production of cut pieces per unit of time is, generally speaking, deemed to be sufficient, i.e., the cutting operation is from a plant production standpoint capable of being performed at a fast enough pace. In fact, for cutting sheet material having a thickness of one and one-half inches or less the process in which the rotary cut-off procedure is utilized has been found to be very good. However, for cutting sheet material having a thickness on the order of a foot or more the process wherein the rotary cut-off procedure is utilized has been found to be impractical. This is because of the fact that the rotors on which the blades are mounted are required for purposes of effectuating the cutting of sheet material of such large thickness to have very large diameters and because of the fact that due to the nature of the operation of rotary blades the cuts made therewith are not perpendicular. On the other hand, insofar as concerns the process in which a circular saw blade is used, the circular saw blade when so employed has been found to be adequate to accomplish the cutting of relatively large thicknesses of sheet material, but has been found to be not fast enough from a plant production standpoint, i.e., from the standpoint of the rate of production of cut pieces of sheet material per unit of time that one is capable of achieving through the use thereof. Accordingly, a need has thus been evidenced in the prior art for a new and improved apparatus suitable for use for purposes of effectuating the cutting of material, and one which is particularly useful for purposes of accomplishing the cutting into desired lengths, with good straight, i.e., perpendicular, cuts and at a desirable plant production rate of speed, of continuous lengths of relatively thick, soft stock sheet material such as sheets of styrofoam embodying a thickness of six inches or greater.

It is, therefore, an object of the present invention to provide a new and improved apparatus operative for effectuating the cutting of material.

It is another object of the present invention to provide such an apparatus operative for accomplishing the cutting of continuous lengths of material into pieces of lesser length.

It is still another object of the present invention to provide such an apparatus operative for accomplishing the cutting of continuous lengths of relatively thick, soft stock sheet material into pieces of lesser length.

A further object of the present invention is to provide such an apparatus which is particularly suited for use for purposes of cutting continuous lengths of styrofoam in sheet form and having a thickness of six inches or greater into pieces having a desired lesser length.

A still further object of the present invention is to provide such an apparatus through the use of which it is possible to achieve good straight, i.e., perpendicular, cuts when effectuating therewith the cutting of continuous lengths of relatively thick, soft stock sheet material such as sheets of styrofoam embodying a thickness of six inches or greater into pieces which are of a desired lesser length.

Yet another object of the present invention is to provide such an apparatus through the use of which it is possible to achieve plant production rates of speed when effectuating therewith the cutting of continuous lengths of relatively thick, soft stock sheet material such as sheets of styrofoam embodying a thickness of six inches or greater into pieces which are of a desired lesser length.

Yet still another object of the present invention is to provide such an apparatus operative for accomplishing the cutting therewith of continuous lengths of relatively thick, soft stock sheet material into pieces of a desired lesser length, and wherein the apparatus is relatively simple in construction, relatively easy to operate while yet being relatively inexpensive to provide.

SUMMARY OF THE INVENTION

In accordance with the present invention, there is provided an apparatus, which is particularly suited for use for purposes of accomplishing the cutting of continuous lengths of relatively thick, soft stock sheet material into pieces which are each of a desired lesser length. More specifically, the subject apparatus is particularly suited for use for purposes of cutting continuous lengths of styrofoam, which is in sheet form and which has a thickness of six inches or greater, into pieces which are each of a desired lesser length. The subject apparatus includes a carriage assembly which is suitably mounted on a support base for movement relative thereto. The carriage assembly is driven by a motor which is mounted thereon and which is operatively connected thereto. As a consequence of the operation of the motor, the carriage assembly is made to move in a triangular path while undergoing movement in two planes and at a speed which varies directly with the speed at which the styrofoam in sheet form that is to be cut into pieces each of a desired length is fed through the subject apparatus. Continuing, the carriage assembly has a knife supported thereon wherein the knife is supported for movement therewith such that as the carriage assembly moves in a triangular path the knife likewise moves in a triangular path, i.e., down and forward. The knife, in order to effectuate the cutting therewith of the styrofoam in sheet form, must at the time of cutting be made to move at the same speed as that at which the styrofoam in sheet form is moving. As such, since the knife follows a triangular path of movement, the knife must be made to move along this triangular path at a speed that is 1.414 times the speed of movement of the styrofoam which being in sheet form is to be cut therewith.

DESCRIPTION OF A PREFERRED EMBODIMENT

Figure 1:
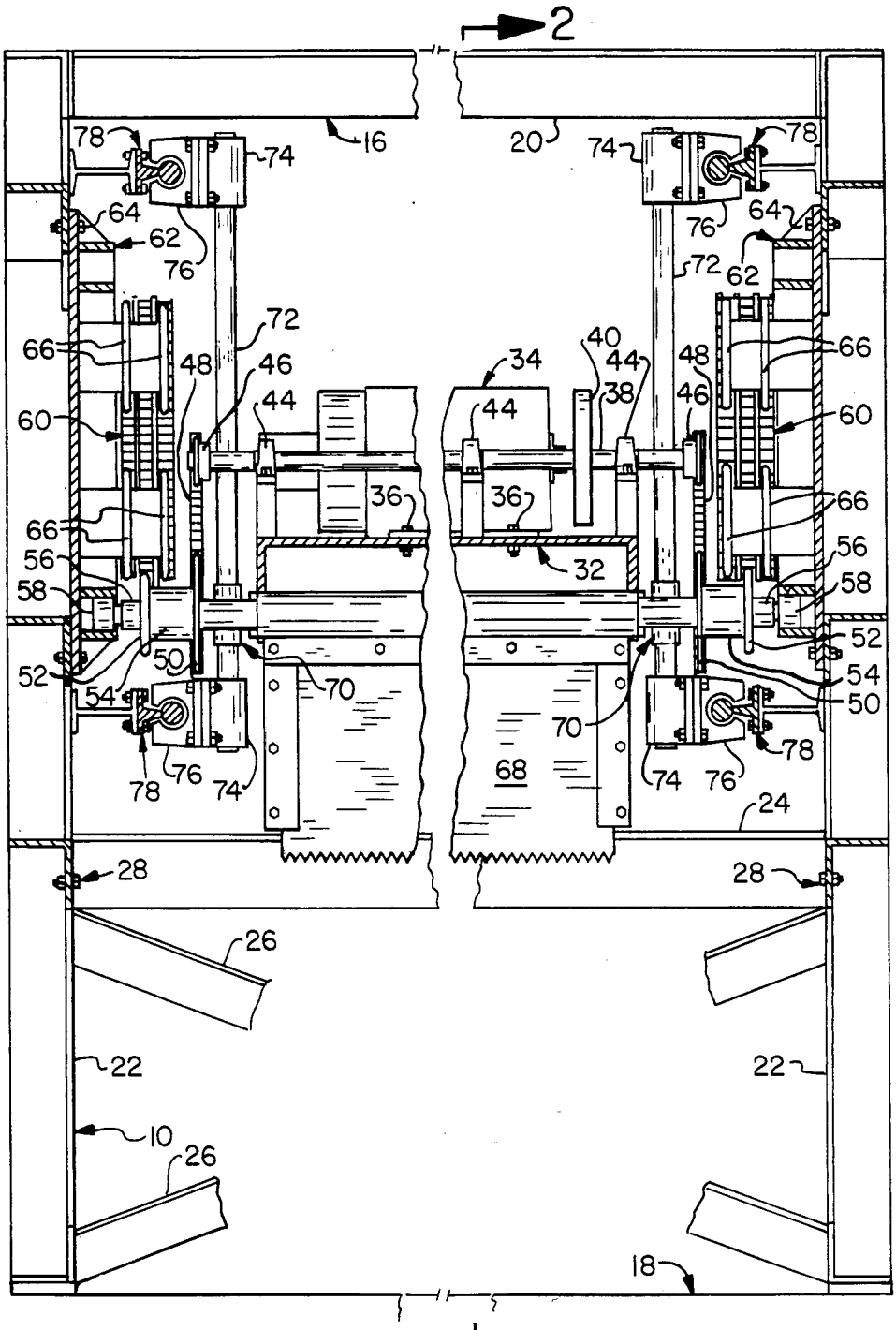
FIG. 1 is an end view partly in section and with some parts broken away for purposes of clarity of illustration of an apparatus, constructed in accordance with the present invention, operative for purposes of accomplishing the cutting of continuous lengths of relatively thick, soft stock sheet material into pieces which are of a desired lesser length.
Figure 2:
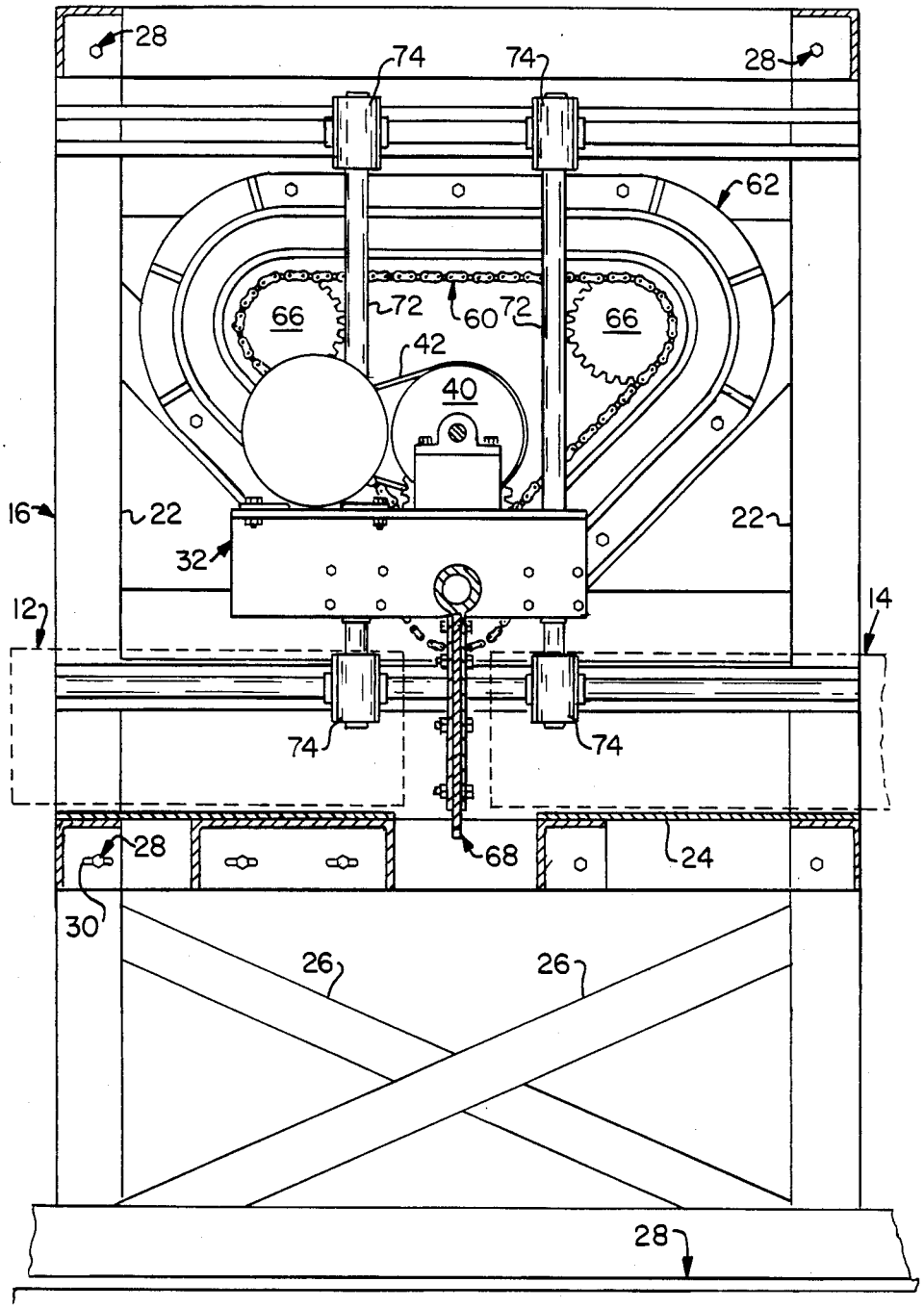
FIG. 2 is a cross-sectional view of the apparatus of FIG. 1, constructed in accordance with the present invention, operative for purposes of accomplishing the cutting of continuous lengths of relatively thick, soft stock sheet material into pieces which are of a desired lesser length, taken substantially along the line 2—2 in FIG. 1.

Referring now to the drawing, and in particular to FIGS. 1 and 2 thereof, there is depicted therein an apparatus, generally designated by the reference numeral 10, constructed in accordance with the present invention. The apparatus 10 is operative for purposes of effectuating the cutting of material into pieces of desired length. Moreover, the apparatus 10, by way of exemplification and not limitation, is particularly suited to be employed for purposes of accomplishing the cutting to the desired size of continuous lengths of relatively thick, soft stock sheet material such as sheets of styrofoam having a thickness of six inches or greater. A sheet of styrofoam which through the operation of the apparatus 10 that forms the subject matter of the present invention has been cut to the desired size as well as a continuous length of styrofoam are shown in FIG. 2, in order to maintain clarity of illustration in the drawing, in dotted lines. Additionally, the cut sheet of styrofoam is identified generally in FIG. 2 by the reference numeral 12 whereas the continuous length of styrofoam is identified generally in FIG. 2 by the reference numeral 14.

The apparatus 10, as best understood with reference to FIGS. 1 and 2 of the drawing, includes a support structure, i.e., a machine frame, the latter being identified generally in the drawing by means of the reference numeral 16. The support structure 16 preferably is intended to rest on a floor-like surface such as that which is identified generally at 18 in FIGS. 1 and 2 of the drawing. In accord with the illustration thereof in the drawing, the support structure 16 is comprised of a plurality of interconnected angle-like members. More specifically, the support structure 16 includes a top member 20, the latter lying in a plane that extends in a first direction, i.e., substantially horizontally; a plurality of side members identified each by the same reference numeral in the drawing, i.e., reference numeral 22, and lying in planes that are parallel to each other and which extend in a second direction that is substantially perpendicular to the aforedescribed first direction of the top member 20, i.e., substantially vertically; and an intermediate member 24 that lies in a plane which is spaced from but extends parallel to the plane in which the top member 20 lies. As will be described more fully hereinafter, the intermediate member 24 is designed to serve as a support surface for the continuous lengths of sheet material, e.g., the continuous length of styrofoam 14, as the latter is made to pass through the apparatus 10 constructed in accordance with the present invention and during which passage the continuous lengths of sheet material are cut into pieces of the desired length, e.g., the piece of styrofoam identified by the reference numeral 12 that has been cut to size.

Continuing, for purposes of providing added strength thereto, the support structure 16 as best understood with reference to FIGS. 1 and 2 of the drawing preferably also includes a plurality of bracing members, each identified by the same reference numeral, i.e., the reference numeral 26. The bracing members 26 as shown in FIGS. 1 and 2 of the drawing are suitably positioned so as to extend diagonally between respective ones of the plurality of side members 22. Any suitable conventional form of fastening means may be utilized for purposes of effectuating the interconnection of the various components that collectively comprise the support structure 16, i.e., the top member 20, the plurality of side members 22, the intermediate member 24 and the plurality of bracing members 26, including but not limited to the conventional threaded fasteners and nuts collectively identified generally in the drawing by the reference numeral 28. When fastening means in the form of the conventional threaded fasteners and nuts 28 is being employed to effectuate the interconnection of the various members, i.e., the members 20, 22, 24 and 26 that collectively comprise the support structure 16, preferably for ease of assembly, i.e., to facilitate the making of adjustments in position, the threaded fasteners 28 are made to pass through suitably dimensioned slots, i.e., the slots identified by the reference numeral 30 in FIG. 2 of the drawing.

The support structure 16 functions as a support base for a carriage assembly, the latter being identified generally in FIG. 2 of the drawing by the reference numeral 32. In a manner yet to be described, the carriage assembly 32 is mounted on the support structure 16 for movement relative thereto. Moreover, suffice it to say for the moment in this connection that the carriage assembly 32 has mounted thereon a drive motor, which in FIG. 1 of the drawing is identified generally by the reference numeral 34. To this end, the drive motor 34 may be mounted on the carriage assembly 32 through the use of any suitable conventional form of mounting means such as, for example, the threaded fasteners illustrated in FIG. 1 of the drawing wherein the threaded fasteners are identified by the reference numeral 36. Also, the carriage assembly 32, in a manner well-known to those skilled in the art, is operatively connected to the drive motor 34 so as to be capable of being driven thereby. That is, as will be described more fully hereinafter the carriage assembly 32 is operatively connected to the drive motor 34 such that as a consequence of the operation of the drive motor 34, the carriage assembly is made to move in a triangular path while undergoing movement in two planes and at a speed which varies directly with the speed at which the continuous length of sheet material, e.g., the continuous length of styrofoam 14, that is to be cut into pieces, e.g., the piece of styrofoam 12, each of a desired length, is, in accord with the mode of operation thereof, fed through the apparatus 10 constructed in accordance with the present invention. Finally, in accord with the best mode embodiment of the invention the drive motor 34 takes the form of a 7½, HP DC motor, 1750 RPM w/tach generator.

Referring again to FIGS. 1 and 2 of the drawing, as best understood with reference thereto the drive motor 34 is operatively connected in known fashion to a counter shaft which can be found illustrated in FIG. 1 of the drawing wherein the counter shaft is denoted by the reference numeral 38. That is, the counter shaft 38 is driven by means of a pair of timing sprockets, only one of which in the interest of maintaining clarity of illustration in the drawing is visible in FIG. 2 of the drawing wherein the timing sprocket that is illustrated therein is identified by the reference numeral 40. More specifically, one of the timing sprockets, i.e., the one not shown, is mounted for rotation on the shaft (not shown) of the drive motor 34 whereas the other one of the timing sprockets, i.e., the one identified by the reference numeral 40, is mounted on the counter shaft 38 so as to be operative to impart rotation thereto when the timing sprocket is caused to rotate by virtue of the rotation imparted thereto from the timing sprocket (not shown) through the timing belt seen at 42 in FIG. 2 of the drawing, which in known fashion serves to interconnect the two timing sprockets 40 one to another.

As shown in FIG. 1 of the drawing, the counter shaft 38 is made to pass through three pillow block bearings, each of which has been identified by the same reference numeral, i.e., the reference numeral 44 in FIG. 1. Each of the three pillow block bearings 44 in turn is suitably mounted through the use of any conventional form of mounting means, such as through the use of conventional threaded fasteners (not shown), on the carriage assembly 32 so as to be movable therewith. Also, the counter shaft 38 in accord with the best mode embodiment of the invention has a sprocket, seen at 46 in FIG. 1 of the drawing, secured thereto at each end thereof for rotation therewith. The rotation, which is imparted thereto by the rotation of the counter shaft 38, of each of the sprockets 46 is transmitted by the chains seen at 48 in FIG. 1 of the drawing to the sprockets that are identified by the reference numerals 50 and 52, respectively, in FIG. 1 of the drawing. Namely, each of the sprockets 46 is operative to effectuate the rotation of a pair of sprockets 50 and 52 by means of a chain 48.

With reference further to the matter of the sprockets 50 and 52, each pair thereof in accord with the best mode embodiment of the invention is mounted on a common hub, the latter being denoted by the reference numeral 54 in FIG. 1 of the drawing. Continuing, each of the hubs 54 as best understood with reference to FIG. 1 of the drawing, is suitably positioned on a shaft, which is identified in the drawing by the reference numeral 56. Moreover, each of the hubs 54 has positioned therewithin in supported relation thereto a bearing (not shown) whereby as a consequence of the operation of these bearings (not shown) the hubs 54 are able to each turn freely on the shaft 56. As best seen with reference to FIG. 1 of the drawing, the shaft 56 extends at each end thereof through a hub 54, i.e., through a pair of sprockets 50 and 52, and has a cam follower bearing 58 positioned thereon at each end thereof, i.e., the shaft 56 at each end thereof for a purpose yet to be described has a cam follower bearing 58 suitably mounted thereon for rotation therewith. Also, in accord with the illustration thereof in FIG. 1 of the drawing the shaft 56 is depicted therein as being securely fastened through the use of any conventional form of fastening means (not shown) to the carriage assembly 32 such that the carriage assembly 32 will undergo the same movement that the shaft 56 itself undergoes.

Referring again to FIG. 1 of the drawing, one of the two sprockets, i.e., the sprocket 52 as contrasted to the sprocket 50, which in accord with the illustration thereof in FIG. 1 is mounted on each of the hubs 54, the latter hubs 54 being located at each end of the shaft 56, follows a chain track, each of the latter being denoted generally in FIG. 1 by the same reference numeral, i.e., the reference numeral 60, as each of the sprockets 52 is subjected to movement as a consequence of the motion that is imparted thereto when the shaft 56 on which the sprockets 52 are mounted undergoes movement. Namely, as the shaft 56 is subjected to movement, each of the sprockets 52, as a result of this movement by the shaft 56, is caused to move, i.e., turn, in a corresponding one of the chain tracks 60. To this end, such a chain track 60 is positioned for this purpose in juxtaposed relation to the shaft 56 at each end thereof.

Continuing, as each of the sprockets 52 moves, i.e., turns, relative to a corresponding one of the chain tracks 60, the former, i.e., the sprockets 52, are made to follow the path that is established by the chain tracks 60. In turn, this results in the entire carriage assembly 32 as well as everything mounted on the carriage assembly 32 being moved also around the path established by the chain tracks 60. The carriage assembly 32 moves in the aforedescribed manner due to the fact that the carriage assembly 32 is securely fastened, in the manner which has been described herein previously, to the shaft 56 to which at each end thereof the sprockets 52 are affixed for movement therewith. Thus, by virtue of the aforedescribed interconnection that is provided by the shaft 56 between the carriage assembly 32 and the sprockets 52, the carriage assembly is made to follow the same path of movement as the sprockets 52, i.e., the path of movement established for the sprockets 52 by the chain tracks 60. As will be described more fully hereinafter, this path of movement that the sprockets 52 follow and, therefore, which is also followed by the carriage assembly 32 is substantially triangular in nature.

As best understood with reference to FIG. 2 of the drawing, the triangular shape of the path of movement that the sprockets 52 follow and thereby that the carriage assembly 32 also follows is in actuality determined by the nature of the shape of a pair of guide tracks, the latter being denoted generally by the reference numeral 62 in the drawing. In accord with the best mode embodiment of the invention, the apparatus 10 constructed in accordance with the present invention embodies a pair of such guide tracks 62. Although only one such guide track 62 is depicted in FIG. 2 of the drawing in the interest of maintaining clarity of illustration therein, both guide tracks 62 are shown in FIG. 1 of the drawing. It can be seen based on a reference to FIG. 1 of the drawing that one such guide track 62 is suitably mounted, by means of any suitable conventional form of mounting means such as the conventional threaded fasteners identified by the reference numeral 64 in the drawing, in supported relation on a corresponding one of the side members 22 of the support structure 16 of the apparatus 10. To thus summarize, the path of movement that is followed by the sprockets 52 and thereby that is also followed by the carriage assembly 32 is dependent upon the nature of the configuration of the guide track 62, which preferably are made of steel. More specifically, this path of movement that the sprockets 52 and the carriage assembly 32 both follow conforms to the path of movement which the cam follower bearings 58, to which reference has previously been had hereinbefore, follow as they ride in the guide tracks 62. As such, based on the previous discussion it should be readily apparent, therefore, that the chain tracks 60 and the guide tracks 62 are both substantially triangular in configuration, i.e., that both embody essentially the same configuration. In this regard, the chain tracks 60 are held in place by means of a plurality of sprockets, the latter each being denoted in the drawing by the same reference numeral, i.e., the reference numeral 66. With further reference to the sprockets 66, the latter do not turn but rather are intended to function only as a means of ensuring that the chain tracks 60 embody the desired shape, i.e., a triangular shape. Likewise, the chain tracks 60 do not move but rather are only intended to serve as a means of causing the carriage assembly 32 to move around the guide tracks 62.

Continuing, as the carriage assembly 32 follows its path of movement, i.e., moves around the previously described triangular path, the carriage assembly 32 must maintain the same orientation, i.e., the same attitude as that in which the carriage assembly is depicted in FIGS. 1 and 2 of the drawing. More specifically, the motor 32 which as viewed with reference to FIG. 1 of the drawing is mounted on the top of the carriage assembly 32 must remain so positioned thereon, i.e., in the manner depicted in FIG. 1 of the drawing, as the carriage assembly 32 moves around the triangular path that has been described previously herein. Similarly, the knife blade, which is designated generally by the reference numeral 68 in the drawing, and which as best understood with reference to FIG. 2 is suitably secured to the carriage assembly 32 through the use of any conventional form of fastening means such as to depend from the carriage assembly 32 in a downwardly direction as viewed with reference to FIGS. 1 and 2 of the drawing must likewise maintain its same orientation, i.e., must remain positioned in the manner depicted in FIGS. 1 and 2 of the drawing as the carriage assembly 32 moves around the previously described triangular path. With further regard to the knife blade 68, the latter, more specifically, is suitably supported on the shaft 56 which in turn is securely fastened to the carriage assembly 32. Accordingly, by virtue of the interconnection that exists between the knife blade 68 and the carriage assembly 32, the knife blade 68 is made to follow the same path of movement as that which the carriage assembly 32 itself follows.

The manner in which the carriage assembly 32 is made to maintain the proper orientation throughout its travel around the aforereferenced triangular path is as follows. The carriage assembly 32 is suitably supported within the apparatus 10 so as to be capable of moving simultaneously in two different planes. For this purpose, the apparatus 10 is provided with four ball bushing pillow blocks, only two of which in the interest of maintaining clarity of illustration in the drawing are to be seen in FIG. 1 of the drawing wherein they are each identified by the same reference numeral, i.e., reference numeral 70. More specifically, the four ball bushing pillow blocks 70, which are each fastened to the carriage assembly 32, are suitably supported for sliding movement relative thereto on the shafts, each of which is identified in the drawing by the reference numeral 72. By virtue of this construction the carriage assembly 32 is capable of movement in a vertical direction as the four ball bushing pillow blocks 70 slide along the vertically oriented, as viewed with reference to FIGS. 1 and 2 of the drawing, shafts 72. In addition, as best understood with reference to FIG. 1 of the drawing each end of each of the shafts 72 is suitably held in place, i.e., in the desired position relative to the side members 22 of the support structure 16 by means of the clamps which are each identified in FIGS. 1 and 2 of the drawing by the reference numeral 74. Since two clamps 74 are associated with each of the shafts 72, there are eight such clamps 74 provided in the apparatus 10. The clamps 74 are each fastened in turn to a ball bushing pillow block, the latter each being denoted for ease of reference by the same reference numeral in the drawing, i.e., the reference 76. As best understood with reference to FIG. 1 of the drawing, each of these ball bushing pillow blocks 76 is suitably supported on a shaft support rail, the latter being identified generally in FIG. 1 by the reference numeral 78 so as to be capable of sliding therealong in a horizontal direction. Moreover, as the ball bushing pillow blocks 76 slide horizontally along the shaft support rails 78 this horizontal movement thereof is in turn transmitted to the carriage assembly 32 such that the carriage assembly 32 also is made to move in a horizontal direction. Thus, it can be seen that the carriage assembly 32 as it moves along the previously described triangular path is made to undergo movement in two planes simultaneously, i.e., is made to move in a vertical plane by virtue of the interconnection that exits between the carriage assembly 32 and the shafts 72 while at the same time is made to move in a horizontal plane by virtue of the interconnection through the shafts 72 that exists between the carriage assembly 32 and the shaft support rails 78. Finally, mention is made here of the fact that each of the shaft support rails 78 is mounted in supported relation on a corresponding one of the side members 22 of the support structure 16.

A description will now be had of the mode of operation of the apparatus 10 constructed in accordance with the illustration thereof as found in FIGS. 1 and 2 of the drawing. As set forth previously herein, the apparatus 10 is intended to be employed for purposes of accomplishing the cutting to the desired size of continuous lengths of relatively thick, soft stock sheet material such as sheets of styrofoam having a thickness of six inches or greater. To this end, the soft stock sheet material seen at 14 in FIG. 2 of the drawing which is to be cut while being supported on the intermediate member 24 is continuously passed by the knife blade 68. After a predetermined length of the material 14 has passed by the knife blade 68 a signal is generated. The specific manner in which this signal is generated is not critical to the operation of the apparatus 10. However, what is critical is that such a signal be generated. As such, this signal may be generated in any number of ways. By way of exemplification and not limitation, one way such a signal may be generated is by basing the signal on the operation of a timer whereby after a preestablished period of time has elapsed which corresponds to the passage of a predetermined length of material 14 by the knife blade 68, the timer causes a signal to be generated. Or, another way such a signal may be generated is through the use of a sensor wherein the sensor is positioned in the path of movement of the continuous length of material 14 and is operative to generate a signal when the sensor senses that a predetermined length of the material 14 has passed by the knife blade 68. Other ways of generating such a signal which have not been described herein could equally well be employed in the operation of the apparatus 10 without departing from the essence of the present invention. Suffice it to say that after a predetermined length of the material 14 has passed by the knife blade 68 a signal is generated. The purpose of this signal is to initiate the action required on the part of the knife blade 68 to effectuate a cutting of the material 14 as the latter moves past the knife blade 68. To this end, this signal is operative to start the motor 34 which is mounted on the carriage assembly 32. Upon being so started, the motor 34 is operative to drive the counter shaft 38 via a pair of timing sprockets, only one of which, i.e., the timing sprocket 40, is seen in the drawing and a timing belt 42. The counter shaft 38 passes through three pillow block bearings 44 which are also mounted on the carriage assembly 32. The counter shaft 38 has a sprocket 46 on each end which is operative via chain 48 to cause sprockets 50 and 52 to turn. The sprockets 50 and 52 are mounted on a common hub 54 with a bearing (not shown) inside so that the hub 54 can turn freely on the shaft 56. Shaft 56 is fastened securely to the carriage assembly 32 and extends on each side through the sprockets 50 and 52 to hold a cam follower bearing 58. As the sprockets 52 turn, the sprockets 52 follow the chain tracks 60 which causes the entire carriage assembly 32 and everything fastened to the carriage assembly 32 to move around in a triangular path. The triangular path is determined by steel guide tracks 62 in which the cam follower bearings 58 ride. The guide tracks 62 embody the same configuration as the chain tracks 60, the latter being held in place by the fixed sprockets 66. The sprockets 66 do not turn but are only used to establish the shape of the chain tracks 60. The chain tracks 60 do not move but are only used to move the carriage assembly 32 around the guide tracks 62. As the carriage assembly 32 moves around in the triangular path the carriage assembly 32 must remain in the same attitude, having the motor 34 on top as viewed with reference to FIG. 1 and the knife blade 68 in a straight down position as viewed with reference to FIGS. 1 and 2. This is accomplished by permitting the carriage assembly 32 to move in two different planes at the same time. To this end, fastened to the carriage assembly 32 are four ball bushing pillow blocks 70 which slide on the shafts 72 to permit the vertical movement of the carriage assembly 32. Each end of the shafts 72 are held by the clamps 74. The clamps 74 are fastened to the ball bushing pillow blocks 76. These ball bushing pillow blocks 76 slide horizontally on the shaft support rails 78 which are mounted on the structural steel side members 22.

Continuing, the motor 34 is a DC motor in which the speed is controlled. The speed of the motor 34 varies directly with the speed at which the soft stock sheet material 14 is being fed through the apparatus 10. In this regard, the soft stock sheet material 14 may be fed through the apparatus by means of any conventional form of feed means (not shown) which is suitable for use for this purpose in the apparatus 10. As the knife blade 68 travels down and forward the knife blade 68 must be moving forward at the same speed as the material 14 it is cutting. Therefore, because the knife blade 68 is traveling in two directions, the speed of the knife blade 68 along the triangular path must be 1.414 times the speed of the material 14 that is being cut by the knife blade 68. After the material 14 is cut by the knife blade 68, the knife blade 68 retracts as the carriage assembly 32 continues following the triangular path. The carriage assembly 32 then comes to a stop at a predetermined spot on the top side as viewed with reference to FIGS. 1 and 2 of the drawings of the triangular path and awaits the generation of another signal representative of the fact that a predetermined length of the material 14 has passed by the knife blade 68 before another cut of the material 14 is initiated. From the preceding it should now be really apparent that one aspect of the construction of the apparatus 10 which serves to advantageously characterize the mode of operation thereof resides in the fact that in the apparatus 10 the triangular movement of the carriage assembly 32 has been combined for purposes of accomplishing the insertion and retraction of the knife blade 68 while the latter is moving horizontally at the same speed as the soft stock sheet material 14 that is being cut. Another aspect of the construction of the apparatus 10 which serves to advantageously characterize the mode of operation thereof is that of the method which is employed for purposes of accomplishing the moving of the carriage assembly 32 wherein there is utilized the fixed chain tracks 60 and the ball bushing pillow blocks 70 such that the carriage assembly 32 is made to move in two directions at the same time.

Thus, in accordance with the present invention there has been provided a new and improved apparatus operative for effectuating the cutting of material. Moreover, the apparatus of the present invention is operative for accomplishing the cutting of continuous lengths of material into pieces of lesser length. In addition, in accord with the present invention the apparatus is operative for accomplishing the cutting of continuous lengths of relatively thick, soft stock sheet material into pieces of lesser length. Further, the apparatus of the present invention is particularly suited for use for purposes of cutting continuous lengths of styrofoam while in sheet form and having a thickness of six inches or greater into pieces having a desired lesser length. Additionally, in accordance with the present invention an apparatus is provided through the use of which it is possible to achieve good straight, i.e., perpendicular, cuts when effectuating therewith the cutting of continuous lengths of relatively thick, soft stock sheet material such as sheets of styrofoam embodying a thickness of six inches or greater into pieces which are of a desired lesser length. Also, the apparatus of the present invention is characterized in that through the use thereof it is possible to achieve plant production rates of speed when effectuating therewith the cutting of continuous lengths of relatively thick, soft stock sheet material such as sheets of styrofoam embodying a thickness of six inches or greater into pieces which are of the desired lesser length. Furthermore, in accord with the present invention an apparatus is provided which is operative for accomplishing the cutting therewith of continuous lengths of relatively thick, soft stock sheet material into pieces of a desired lesser length, and which is relatively simple in construction, and relatively easy to operate while yet being relatively inexpensive to provide.

While only one embodiment of our invention has been shown, it will be appreciated that modifications thereof, some of which have been alluded to hereinabove, may still be readily made thereto by those skilled in the art. We, therefore, intend by the appended claims to cover the modifications alluded to herein as well as all other modifications which fall within the true spirit and scope of our invention.

What is claimed is:

1. An apparatus for cutting continuous lengths of relatively thick, soft stock sheet material while moving into pieces of a lesser length comprising:

(a.) a carriage assembly;

(b.) support means including a support surface for supporting material while being cut;

(c.) mounting means operative to mount said carriage assembly on said support means for movement relative thereto in a triangular path;

(d.) motor means supported on said carriage assembly, said motor means being operatively connected to said carriage assembly so as to be operative to drive said carriage assembly around the triangular path at a speed equal to 1.414 times the speed of movement of the material being cut; and (e.) knife means supported on said carriage assembly for movement therewith, said knife means as said carriage assembly moves around the triangular path being operative to effectuate the cutting of the material being supported on said support surface.

2. The apparatus as set forth in claim 1 further comprising moving means supported on said support means, said moving means being operatively connected to said carriage assembly so as to permit said carriage assembly to move in two planes simultaneously.

3. The apparatus as set forth in claim 2 wherein said moving means includes first moving means supported on said support means, said first moving means being operatively connected to said carriage assembly so as to permit said carriage assembly to move in a first plane, said first plane extending in a vertical direction.

4. The apparatus as set forth in claim 3 wherein said first moving means includes a plurality of vertically extending shafts supported on said support means in spaced relation one to another, and a multiplicity of ball bushing pillow blocks mounted on said plurality of vertically extending shafts for movement relative thereto in a vertical direction.

5. The apparatus as set forth in claim 4 wherein said moving means further includes a second moving means supported on said support means, said second moving means being operatively connected to said carriage assembly so as to permit said carriage assembly while moving in said first plane to move simultaneously in a second plane, said second plane extending in a horizontal direction.

6. The apparatus as set forth in claim 5 wherein said second moving means includes a plurality of horizontally extending shaft support rails supported on said support means in spaced relation one to another, and a multiplicity of ball bushing pillow blocks mounted on said plurality of horizontally extending shaft support rails for movement relative thereto in a horizontal direction.

7. The apparatus as set forth in claim 6 wherein said support surface comprises an intermediate member, said intermediate member lying in a horizontal plane.

8. The apparatus as set forth in claim 7 wherein said support means further includes a top member and a plurality of side members fastened to said top member, said top member lying in a horizontal plane and being spaced from said intermediate member, said plurality of side members lying in vertical planes and being spaced one from another.

9. The apparatus as set forth in claim 8 wherein said support means also includes a plurality of bracing means extending diagonally between said plurality of side members, said plurality of bracing members being fastened to said plurality of side members.

10. The apparatus as set forth in claim 9 wherein said mounting means includes a plurality of chain tracks each embodying a triangular configuration, and a sprocket supported in each of said plurality of chain tracks for movement relative thereto in a triangular path.

11. The apparatus as set forth in claim 10 wherein said mounting means further includes a plurality of guide tracks each embodying a triangular configuration, and a cam follower bearing supported in each of said plurality of guide tracks for movement relative thereto in a triangular path.

12. The apparatus as set forth in claim 11 wherein said motor means includes a DC motor.

13. The apparatus as set forth in claim 12 wherein said knife means includes a knife blade.

* * * * *